United States Patent [19]

Deutschmann et al.

[11] Patent Number: 4,550,568

[45] Date of Patent: Nov. 5, 1985

[54] DIESEL INTERNAL COMBUSTION ENGINE

[75] Inventors: Herbert Deutschmann, Friedrichshafen; Gerd-Michael Wolters, Markdorf, both of Fed. Rep. of Germany

[73] Assignee: MTU-Motoren-und Turbinen-Union Friedrichshafen GmbH, Fed. Rep. of Germany

[21] Appl. No.: 588,784

[22] Filed: Mar. 12, 1984

[30] Foreign Application Priority Data

Jun. 21, 1983 [DE] Fed. Rep. of Germany ..... 3322168

[51] Int. Cl.[4] ..... F02B 37/00

[52] U.S. Cl. ..... 60/612; 123/559; 123/562; 123/27 R

[58] Field of Search ..... 123/27 R, 198 F, 559, 123/560, 562; 60/612

[56] References Cited

U.S. PATENT DOCUMENTS

| | | | |
|---|---|---|---|
| 1,138,077 | 5/1915 | Buchi | 123/27 |
| 1,279,085 | 9/1918 | Davison | 123/27 |
| 1,289,689 | 12/1918 | Davison | 123/27 |
| 1,330,676 | 2/1920 | Blache | 123/27 |
| 1,711,530 | 5/1927 | Hawks | 123/27 |
| 1,729,201 | 9/1929 | Attendu | 123/27 |
| 2,633,698 | 4/1953 | Nettel | 123/27 |
| 4,388,802 | 6/1983 | Dinger et al. | 60/612 |
| 4,422,296 | 12/1983 | Dinger et al. | 60/612 |
| 4,429,533 | 2/1984 | Dinger | 60/612 |

*Primary Examiner*—Ira S. Lazarus

*Attorney, Agent, or Firm*—Craig and Burns

[57] ABSTRACT

In a turbocharged diesel internal combustion engine (10) with low compression ratio, at least one cylinder (11) operating as an engine cylinder is charged during starting and at partial load operation by several cylinders (18, 21, 28) operating as compressors. The pistons of the compressor cylinders (18, 21, 28) lead the piston of the engine cylinder (11). As a result thereof, the engine cylinder can be charged during its compression stroke. The compressor cylinder (28) which by reason of its large angular ignition spacing to the engine cylinder cannot feed directly into the engine cylinder, delivers its supplied air at first to another compressor cylinder (18) which is located more favorably. Only thereafter, the air of the two compressor cylinders (18 and 28) is fed in common and in parallel with a further, possibly also favorably located compressor cylinder (21), to the engine cylinder (11).

6 Claims, 1 Drawing Figure

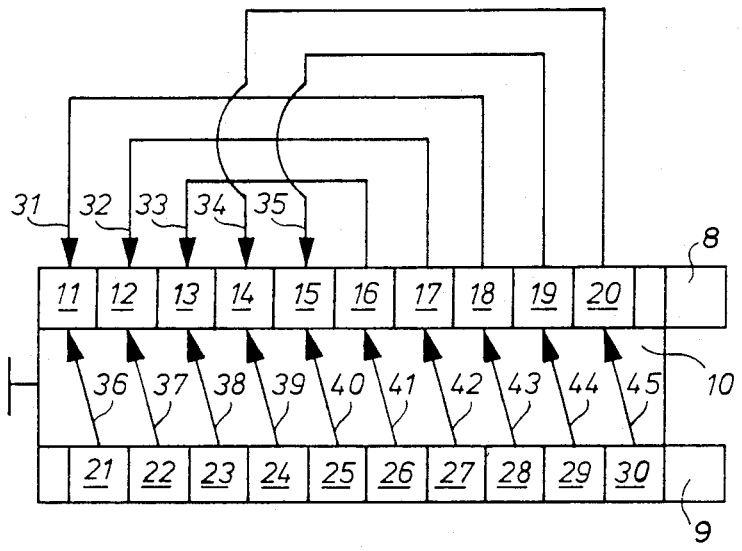
31
32
33
34
35
8
11
12
13
14
15
16
17
18
19
20
36
37
38
39
40
41
42
43
44
45
10
21
22
23
24
25
26
27
28
29
30
9

DIESEL INTERNAL COMBUSTION ENGINE

The present invention relates to an exhaust-gas-turbocharged diesel internal combustion engine with low compression ratio, in which during the starting and in the partial load operation at least one cylinder is operated as an engine cylinder which is charged by a cylinder operated as compression. The piston of the compressor cylinder leads the piston of the engine cylinder in such a manner that the engine cylinder is directly charged by the compressor cylinder by way of a connecting line.

A charging process generally of the type described here is described in the German Offenlegungsschrift No. 26 48 411. As a result thereof, the charging of the exhaust gas turbocharger, which is inadequate during starting and at partial loads, is compensated for and a high compression with corresponding temperatures which are adequate for the ingition of the fuel to be injected, is achieved in the engine cylinders notwithstanding the low compression ratio. Compared to other known processes, this process is simple, operationally reliable and realizable without great additional expenditures and extra space requirement.

However, it is disadvantageous in connection with the process according to the German Offenlegungsschrift No. 26 48 411 that the charging of the engine cylinder which is achievable thereby be limited. A further lowering of the compression ratio in all cylinders which is necessary for the improvement of the power-to-weight ratio of the internal combustion engine, is thus not possible without negative reactions and repercussions on the start and partial load behavior.

Accordingly, it is the object of the present invention to increase the charging in the engine cylinder during starting and partial load operation while maintaining the simple components of the known process.

The underlying problems are solved according to the present invention in that an engine cylinder, in addition to being charged by a first compressor cylinder, is additionally charged by at least one further compressor cylinder.

One advantageous construction of the inventive concept provide for the further compressor cylinder to at first charge the first compressor cylinder, and the piston of the further compressor cylinder to lead the piston of the compressor cylinder in such a manner that the engine cylinder is then charged by the first compressor cylinder with the air quantity of both compressor cylinders.

With internal combustion engines having a large number of cylinders, the inventive concept, however, can also be realized in that the further compressor cylinder directly charges the engine cylinder in parallel to the first compressor cylinder.

A very high charging of the engine cylinder can be finally achieved in accordance with the present invention in that the charging air for the engine cylinder is supplied to the engine cylinder directly by at least one compressor cylinder and indirectly by at least one further compressor cylinder by way of another compressor cylinder.

The advantage of the present invention resides in that the engine cylinder can be charged very strongly without the need to use for that purpose complicated processes with storage devices and additional controls of the charging air. The compression ratio can therewith be further lowered in all cylinders. The simple shifting elements of the German Offenlegungsschrift No. 26 48 411 which have been tested in practical operation can be used thereby. The additional expenditure, extra space requirement, and additional weight can be kept within narrow, acceptable limits.

These and other objects, features and advantages of the present invention will become more apparent from the following description when taken in connection with the accompanying drawing which shows, for purposes of illustration only, one embodiment in accordance with the present invention, and wherein:

The single FIGURE is a schematic view of an exhaust-gas-turbocharged diesel internal combustion engine in accordance with the present invention.

The single FIGURE illustrates schematically a diesel internal combustion engine 10, with two exhaust gas turbochargers 8, 9 which in a known manner supply the internal combustion engine 10, with altogether twenty cylinders 11 to 30 which can be operated with low compression ratio and correspondingly with high charging and therefore exhibit a favorable power-to-weight ratio. For starting and at small partial load, when the associated exhaust gas turbochargers are not able to make any charging air available or are able only to make available small quantities of charging air, the compression and temperature attainable in the cylinders does not suffice for the ignition of the injected fuel. Consequently, the cylinders 16 to 30 are used as compressor cylinders for supplying charging air for the cylinders 11 to 15 which continue to be operated as engine cylinders. As a result thereof, each engine cylinder, in addition to being charged by the air sucked in by the engine cylinder, is so strongly charged by the air of, respectively, three compressor cylinders that the compression and temperature necessary for the ignition of the injected fuel is attained in the engine cylinders.

The charging in accordance with the present invention will now be described by reference to the engine cylinder 11.

The engine cylinder 11 is charged in a known manner by a first compressor cylinder 18 by way of a connecting line 31. A first valve (not shown) controlled corresponding to the operating condition (start, partial load-middle load, full load) of the internal combustion engine and a second valve (not shown) opening in the presence of an excess pressure on the compressor cylinder side are arranged in the connecting line 31. Since these control valves are known as such and form no part of the present invention, a detailed description thereof is dispensed with herein. The piston of the compressor cylinder 18 leads the piston of the engine cylinder 11 in such a manner that the engine cylinder 11 is charged with the compressed air of the compressor cylinder 18 during the compression stroke of the engine cylinder 11.

In order to further increase the charging, a further compressor cylinder 28 is coordinated according to the present invention to the engine cylinder 11, whereby the piston of the further compressor cylinder 28 leads the piston of the first compressor cylinder 18 in such a manner that at first the first compressor cylinder 18 is charged by the further compressor cylinder 28 and thereupon the engine cylinder 11 is charged with the air quantity of both compressor cylinders 18 and 28. The compressor cylinder 28 is connected with the compressor cylinder 18 in a known manner by way of a line 43 of relatively small cross section. This line, as are all other lines illustrated in the drawing, is equipped with the same type of valves as described hereinabove in connection with the line 31.

The engine cylinder 11 is additionally also charged directly by a further compressor cylinder 21 operated in parallel with the first compressor cylinder 18. This possibility exists if the internal combustion engine has a large number of cylinders and, as a result thereof, two cylinders are available with the angular ignition spacing necessary for a direct charging which during the compression stroke of the engine cylinder are able to charge the latter. This additional compressor cylinder 21 is connected with the engine cylinder 11 by way of a line 36 of relatively small cross section, the line 36 corresponding in its operation to line 31.

In the same manner as described hereinabove for the engine cylinder 11, the remaining engine cylinders 12 to 15 are charged by the compressor cylinders 17 to 20, 22 to 25, 26, 27, 29 and 30. The direction in which the compressed air is supplied in each case is indicated by arrows.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A diesel internal combustion engine, with low compression ratio and which is charged by an exhaust gas turbocharger, comprising a plurality of cylinders, at least one of said plurality of cylinders being operated as an engine cylinder during starting and partial load operation, said engine cylinder being charged by another cylinder of said plurality of cylinders operated as a compressor, the piston of the cylinder operated as a compressor leading the piston of the engine cylinder in a manner such that the engine cylinder is charged directly by the cylinder operated as a compressor by way of a connecting line, and the engine cylinder being additionally charged by a further cylinder of said plurality of cylinders operated as a compressor.

2. A diesel internal combustion engine according to claim 1, wherein the further cylinder operated as a compressor charges at first the first-mentioned cylinder operated as a compressor, the piston of the further cylinder operated as a compressor leading the piston of the first-mentioned cylinder operated as a compressor, the engine cylinder being charged by the first-mentioned cylinder operated as a compressor with the air quantity of the two compressor cylinders.

3. A diesel internal combustion engine according to claim 2, wherein the further cylinder operated as a compressor directly charges the engine cylinder in parallel with the first-mentioned cylinder operated as a compressor.

4. A diesel internal combustion engine according to claim 3, wherein the charging air for the engine cylinder is supplied directly to the engine cylinder by at least one cylinder operated as a compressor and indirectly by at least one further cylinder operated as a compressor by way of another cylinder operated as a compressor.

5. A diesel internal combustion engine according to claim 1, wherein the further cylinder operated as a compressor directly charges the engine cylinder in parallel with the first-mentioned cylinder operated as a compressor.

6. A diesel internal combustion engine according to claim 1, wherein the charging air for the engine cylinder is supplied directly to the engine cylinder by at least one cylinder operated as a compressor and indirectly by at least one further cylinder operated as a compressor by way of another cylinder operated as a compressor.

* * * * *